US009181662B2

(12) United States Patent
Kopacz et al.

(10) Patent No.: US 9,181,662 B2
(45) Date of Patent: Nov. 10, 2015

(54) LOWER SCREED INTERFACES

(71) Applicant: Caterpillar Paving Products Inc., Brooklyn Park, MN (US)

(72) Inventors: Jason Kopacz, St. Louis Park, MN (US); Timothy Wehrenberg, Maple Grove, MN (US); Joseph P. Spee, Champlin, MN (US); Tobin D. Rasmusson, Bloomington, MN (US); Igor Ramos, Minnetonka, MN (US); LaTanya Turner, St. Paul, MN (US); John Jorgensen, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 13/933,640

(22) Filed: Jul. 2, 2013

(65) Prior Publication Data

US 2015/0010355 A1 Jan. 8, 2015

(51) Int. Cl.
*E01C 23/14* (2006.01)
*E01C 19/48* (2006.01)

(52) U.S. Cl.
CPC ..... *E01C 19/48* (2013.01); *E01C 2301/10* (2013.01); *E01C 2301/16* (2013.01); *Y10T 29/49815* (2015.01)

(58) Field of Classification Search
USPC ..... 404/95, 188, 118
IPC ..... E01C 23/14
See application file for complete search history.

(56) References Cited

U.S. PATENT DOCUMENTS

| | | | | |
|---|---|---|---|---|
| 5,417,516 | A | 5/1995 | Birtchet | |
| 6,318,928 | B1 * | 11/2001 | Swearingen | 404/72 |
| 6,963,050 | B2 * | 11/2005 | Heindtel | 219/213 |
| 6,981,820 | B2 * | 1/2006 | Nelson | 404/118 |
| 7,427,174 | B2 * | 9/2008 | Dearing | 404/95 |
| 8,113,737 | B2 * | 2/2012 | Mahler et al. | 404/95 |
| 8,113,738 | B2 * | 2/2012 | Mahler et al. | 404/95 |
| 8,157,474 | B2 * | 4/2012 | Mahler et al. | 404/95 |
| 8,517,630 | B2 * | 8/2013 | Graham et al. | 404/118 |
| 2008/0292401 | A1 * | 11/2008 | Potts | 404/95 |
| 2010/0310312 | A1 | 12/2010 | Mahler et al. | |
| 2011/0002738 | A1 | 1/2011 | Mahler et al. | |
| 2013/0142571 | A1 * | 6/2013 | Graham et al. | 404/118 |

FOREIGN PATENT DOCUMENTS

| | | |
|---|---|---|
| EP | 1416092 A2 | 5/2004 |
| JP | 10252012 | 9/1998 |

* cited by examiner

*Primary Examiner* — Gary Hartmann
(74) *Attorney, Agent, or Firm* — Baker & Hostetler LLP

(57) ABSTRACT

A screed assembly includes a screed assembly frame and a screed plate removably connected to the screed assembly frame to define a space between the screed assembly frame and the screed plate. A heating element and a hold down device for securing the heating element can be provided in the space between the screed assembly frame and the screed plate. The heating element is configured to be removed from the space by sliding the heating element out of the space and disengaging the heating element from the hold down device without removing the screed plate from the screed assembly frame.

20 Claims, 12 Drawing Sheets

LOWER SCREED INTERFACES

TECHNICAL FIELD

This patent disclosure relates generally to asphalt paving machines and, more particularly, to various aspects of an electrically heated screed assembly.

BACKGROUND

The laying of asphalt paving material on road surfaces entails spreading paving material consisting of an aggregate filled bituminous mixture on a prepared roadbed. The paving material is spread while hot and is then compacted so that upon cooling a hardened pavement surface is formed. Conventional paving machines utilize a heavy assembly termed a "screed" that is drawn behind the paving machine. The screed includes a replaceable screed plate that is constructed of a suitable steel, to spread a smooth even layer of paving material on the prepared roadbed. The weight of the screed assembly aids to compress the paving material and perform initial compaction of the paving material layer. Screed assemblies can include vibratory mechanisms placed directly on the screed plate or separate vibratory tamper bars connected in tandem with the screed plate to aid in the initial compaction of the paving material.

To facilitate laying of the paving material, the screed is typically heated, to a temperature in the range of about 82° to 171° C. (180° to 340° F.). Heating the screed assists the paving material in flowing under the screed and reduces adhesion of the paving material to the screed. If the screed is not adequately heated, the bituminous mixture contacts the bottom of the screed and begins to harden, resulting in buildup of paving material and excessive drag.

Conventional screed assemblies were commonly heated by fossil fuel powered burners that heat the upper surface of the screed plate by the direct application of flame or hot exhaust gases. More recently, screed assemblies with electrically powered heating elements are being used, wherein the heating elements are usually bonded or tightly secured to an upper surface of the screed plate.

For example, as shown in U.S. Pat. No. 5,417,516, a heated screed assembly for use with a paving machine includes a screed with an elastomeric, electrically-powered heating element carried on the upper surface of the screed. To ensure that movement of the heating elements along a plane of the upper surface is substantially prevented during operation of the screed assembly, and to also ensure that the heating elements stay in intimate contact with the screed while being vibrated during operation, a layer of insulation is placed on top of the heating elements and a retaining plate assembly, which is a heavy steel grid member, is placed on top of the insulation to hold the heating elements and the insulation in place. The design requires loose components placed on top of one another to maintain full contact of the heating elements with the screed.

Screed assemblies by nature operate in an extremely abusive environment that may easily cause damage to or failure of key components. The heating elements of a screed assembly are among the key components that may require repair or replacement. However, the heavy nature of the equipment involved and the design of conventional screed assemblies requires that any such maintenance must normally be carried at a depot or shop location, for example, wherein the entire frame of the screed assembly must be disassembled in order to repair or replace the malfunctioning heating element. Furthermore, the use of multiple pieces to adequately hold down the heating elements in conventional screed assemblies adds to the time consuming and labor intensive process to repair or replace heating elements.

The present invention is directed to overcome one or more of the problems as set forth above.

SUMMARY

The foregoing needs are met, to a great extent, by the disclosure, wherein in accordance with one embodiment a screed interface assembly includes a screed assembly frame, a screed plate removably connected to the screed assembly frame to define a space between the screed assembly frame and the screed plate, a heating element, and a hold down device for securing the heating element in the space, the heating element configured to be removed from the space by sliding the heating element out of the space and disengaging the heating element from the hold down device without removing the screed plate from the screed assembly frame.

In accordance with one embodiment a paving system for laying an asphalt paving material includes a paving machine having an engine and a propelling arrangement, and a screed assembly attached to the paving machine, wherein the screed assembly has a screed assembly frame, a screed plate removably connected to the screed assembly frame to define a space between the screed assembly frame and the screed plate, a heating element, and a hold down device for securing the heating element in the space, the heating element configured to be removed from the space by sliding the heating element out of the space and disengaging the heating element from the hold down device without removing the screed plate from the screed assembly frame.

In accordance with one embodiment a method of removing a heating element from a screed assembly having a screed plate coupled to a screed assembly frame includes disengaging the heating element from a hold down device by sliding the heating element out of a space defined between the screed plate and the screed assembly frame while maintaining the coupling of the screed plate to the screed assembly frame.

DETAILED DESCRIPTION

Figure 1:
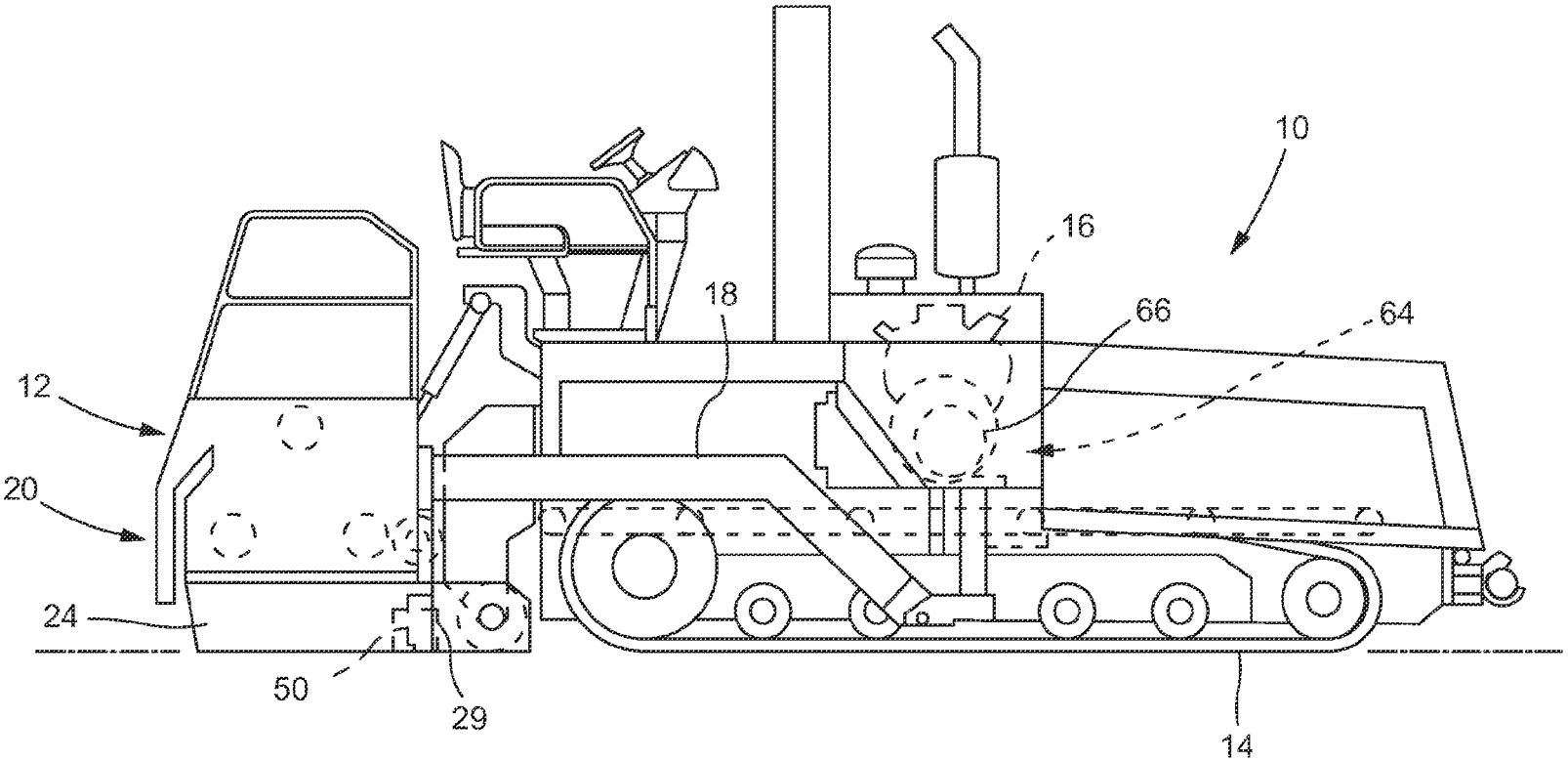
FIG. 1 is a side view of a paving machine with a screed assembly, in accordance with aspects of the present disclosure.

The disclosure will now be described with reference in the drawing figures, in which like reference numerals refer to like parts throughout.

Various aspects of the lower screed interfaces may be illustrated by describing components that are connected, attached, and/or joined together. As used herein, the terms "connected", "attached", and/or "joined" are used to indicate either a direct connection between two components or, where appropriate, an indirect connection to one another through intervening or intermediate components. In contrast, if a component is referred to as being "directly coupled", "directly attached", and/or "directly joined" to another component, there are no intervening elements present.

Embodiments of the disclosure advantageously provide systems and methods for using lower screed interfaces. The lower screed interfaces described herein provide advantages for the repair and/or replacement of component parts of a screed assembly in a paving machine in a safe and effective manner. The systems and methods described herein are applicable for use with paving machines and, in particular, paving machines that use a heavy screed assembly drawn behind the paving machine for heating and shaping the asphalt to form the road service.

Referring to the drawings, specifically FIG. 1, an asphalt paving machine 10 is shown with a screed assembly 12 attached to the back thereof. The asphalt paving machine 10 is supported by a propelling arrangement 14 that is driven by an engine 16 in a conventional manner.

Figure 2:
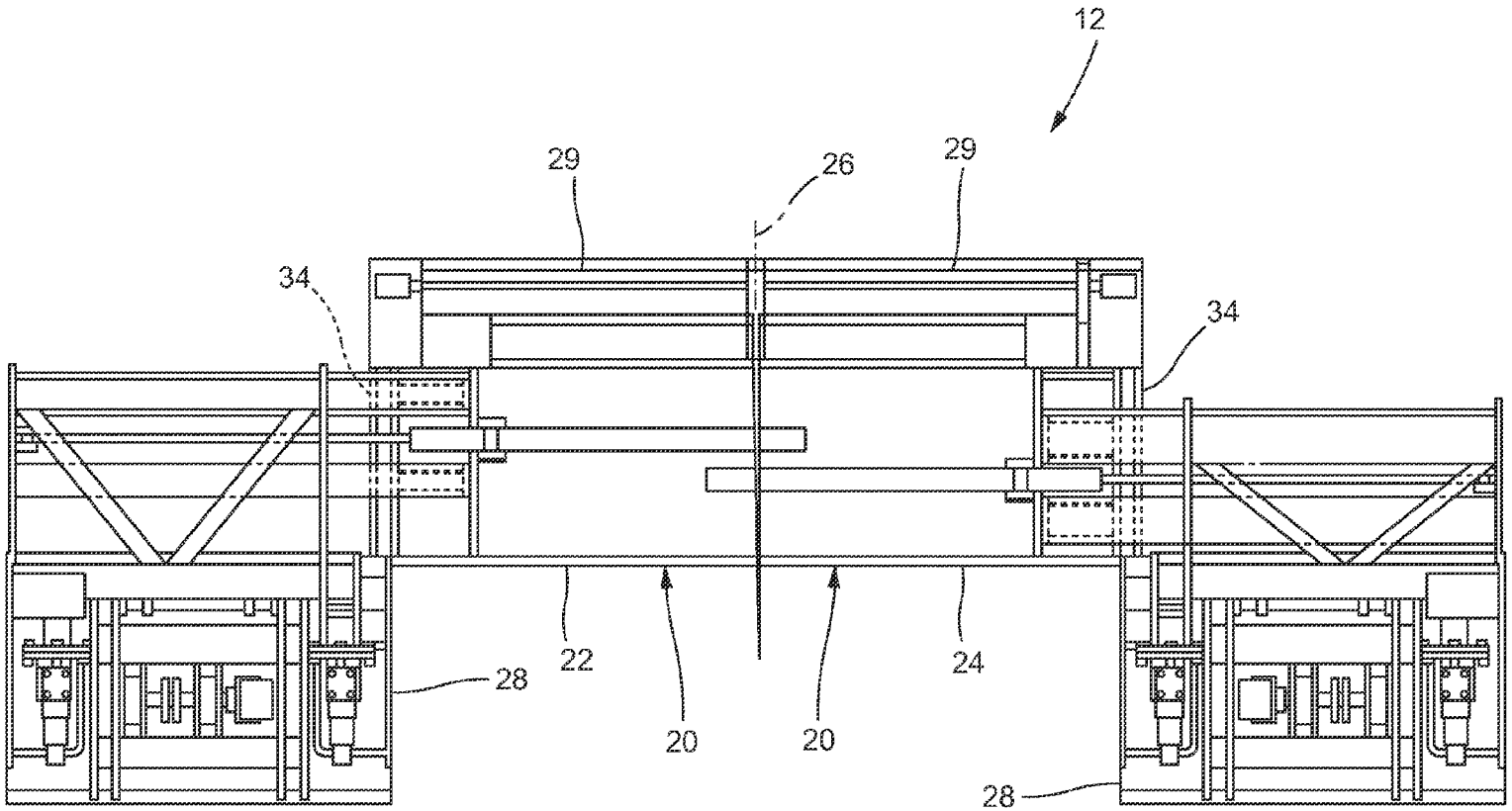
FIG. 2 is a plan view of a screed assembly, in accordance with aspects of the present disclosure.

In accordance with aspects of the disclosure, the screed assembly 12 may be pivotally connected behind the asphalt paving machine 10 by tow arms 18. The screed assembly 12 may be any of a number of configurations such as a fixed width screed or a multiple section screed that includes extensions. As shown in FIG. 2, the screed assembly 12 may be provided with a main screed section 20 having a left screed section 22 and a right screed section 24, for example. The left and right screed sections 22, 24 may be hingably connected to one another along a longitudinal centerline 26 so that various operations, such as crowning, can be performed. A screed extension 28 may also be provided behind and adjacent to both the left and right screed sections 22,24. It should also be understood that screed extensions 28 may be positioned in front of the main screed section 20 without departing from the gist of the present invention. Screed extensions 28 are slidably movable, such as by actuators (not shown), so that varying widths of paving material can be laid. The screed assembly 12 may also include a tamper bar arrangement 29 positioned forward of the main screed section 20, as shown in FIGS. 1 and 2. Alternatively, some screed assemblies 12 include a vibratory mechanism (not shown) positioned above the left and right screed sections 22,24 and the screed extensions 28 to aid in the initial compaction of the paving material being laid down.

Figure 3:
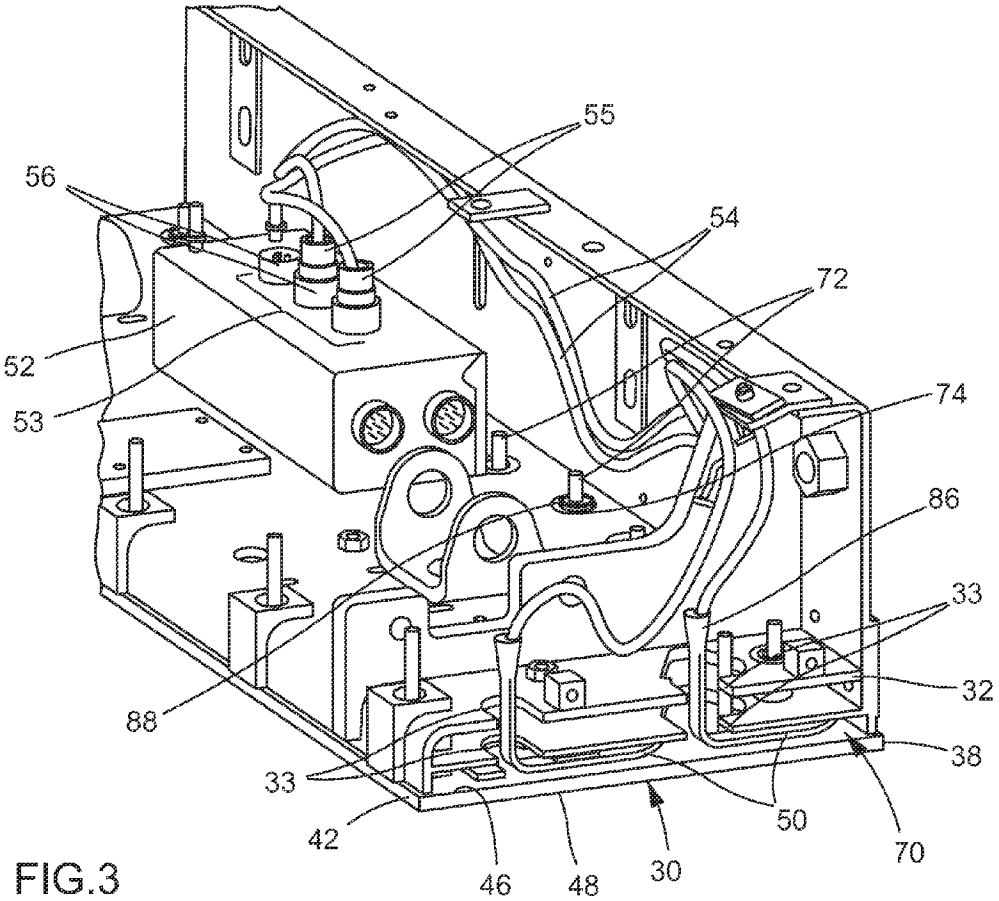
FIG. 3 is a close up perspective view of a screed assembly, in accordance with aspects of the present disclosure.

Referring to FIGS. 2 and 3, each of the screed sections 22, 24, 28 may include a screed plate 30 that is removably connected to and supported by a frame 32. End plates 34 (see FIG. 4) may provide reinforcement to the frame 32. The frame 32 may integrally form an external housing, or an external housing may be mounted to the frame 32, to provide protection of the internal components of the screed assembly 12 from the harsh operating environment. In accordance with other aspects of the present invention, access panels, for example, may be configured into the housing to provide efficient access to the internal components of the screed assembly 12.

Figure 4:
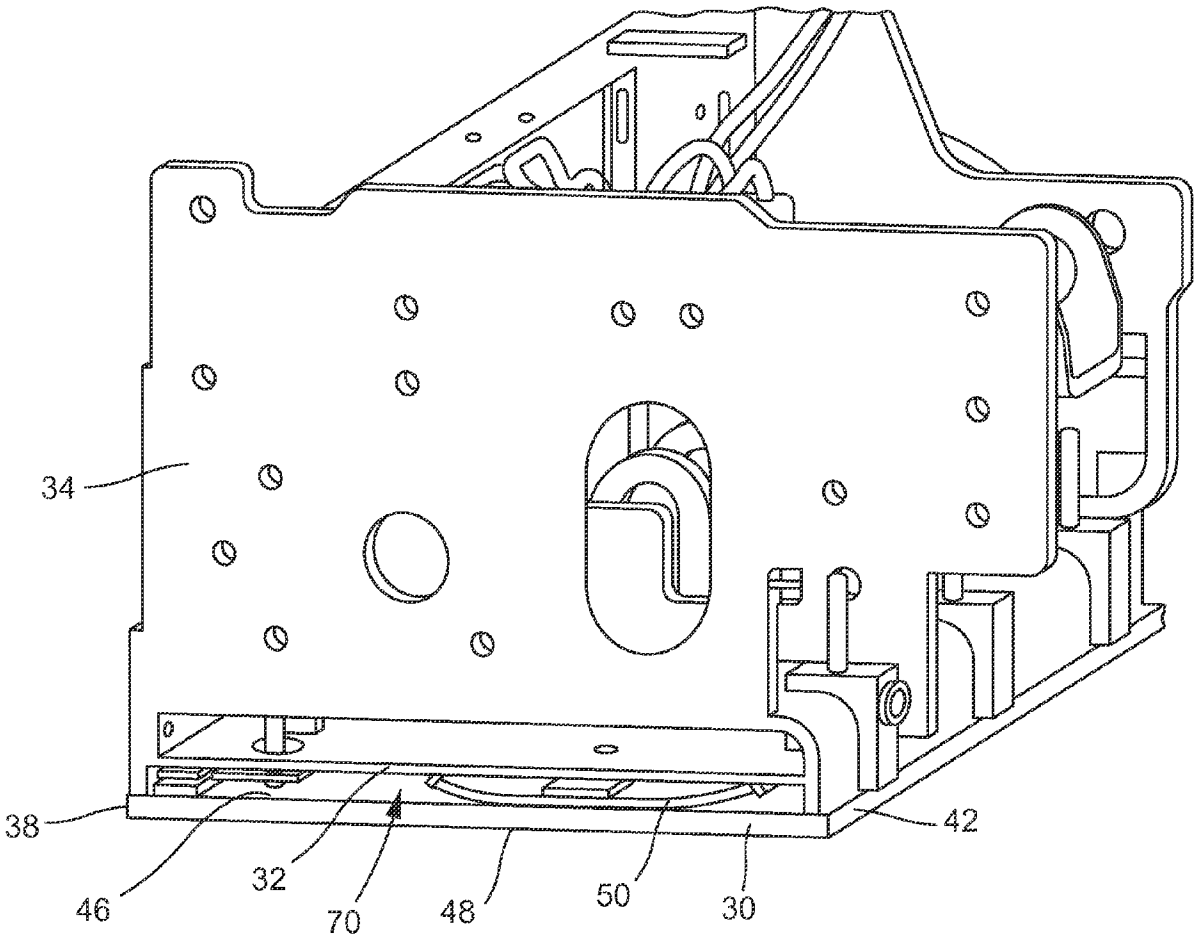
FIG. 4 is another close up perspective view of a screed assembly, in accordance with aspects of the present disclosure.

As shown in FIGS. 3 and 4, the screed plate 30 may have a forward leading edge 38, a rearward trailing edge 42, and define an upper surface 46 and a lower surface 48 extending between the leading edge and the trailing edge 42. As used herein, "forward" generally refers to the portion of the screed assembly 12 that faces the asphalt paving machine 10, while "rearward" refers to the portion distal from the asphalt paving machine 10. In use, the screed assembly is pulled behind the asphalt paving machine 10 so that the paving material is fed under the screed plate 30.

Each screed plate 30 in the screed assembly 12 is heated by a screed heating assembly that may include one or more removable heating elements 50 electrically coupled to a junction box 52. The heating elements 50 may be resistive type heating elements having leads 54 for connecting to the junction box 52.

The junction box 52 may be mounted to the frame 32 and electrically couple to an electric power supply 64 (see FIG. 1), which may include an electric generator 66, for example, that is operatively connected to the engine of the asphalt paving machine 10. The generator 66 may, for example, be an AC or DC generator such as a 12 or 24 volt DC or 110 or 240 AC generator. The output connections of the power supply 64 may be wired into the junction box 52 of the heating assembly. In accordance with certain aspects of the present disclosure, military style connectors 53 may be used to complete the electrical circuit between the leads 54 of the heating elements 50 and the output connections of the power supply 64. For example, the leads 54 may each have a male military style pin connector 55 that mates with a female military style socket connector 56 extending from the junction box 52. The connectors 55 and 56 may be secured together by a locking mechanism, such as a threaded locking nut, to prevent disengagement during the harsh operating conditions and extensive vibrations experienced by the screed assembly 12.

As shown in FIGS. 3 and 4, the frame 32 defines a space 70 when mounted to the screed plate 30. In accordance with aspects of the present invention, the heating elements 50 may slide into and/or out of the space 70 for easy and efficient installation, removal and/or replacement with minimum manipulation of parts and without the entire disassembly of the frame 32 from the screed plate 30.

Figure 5:
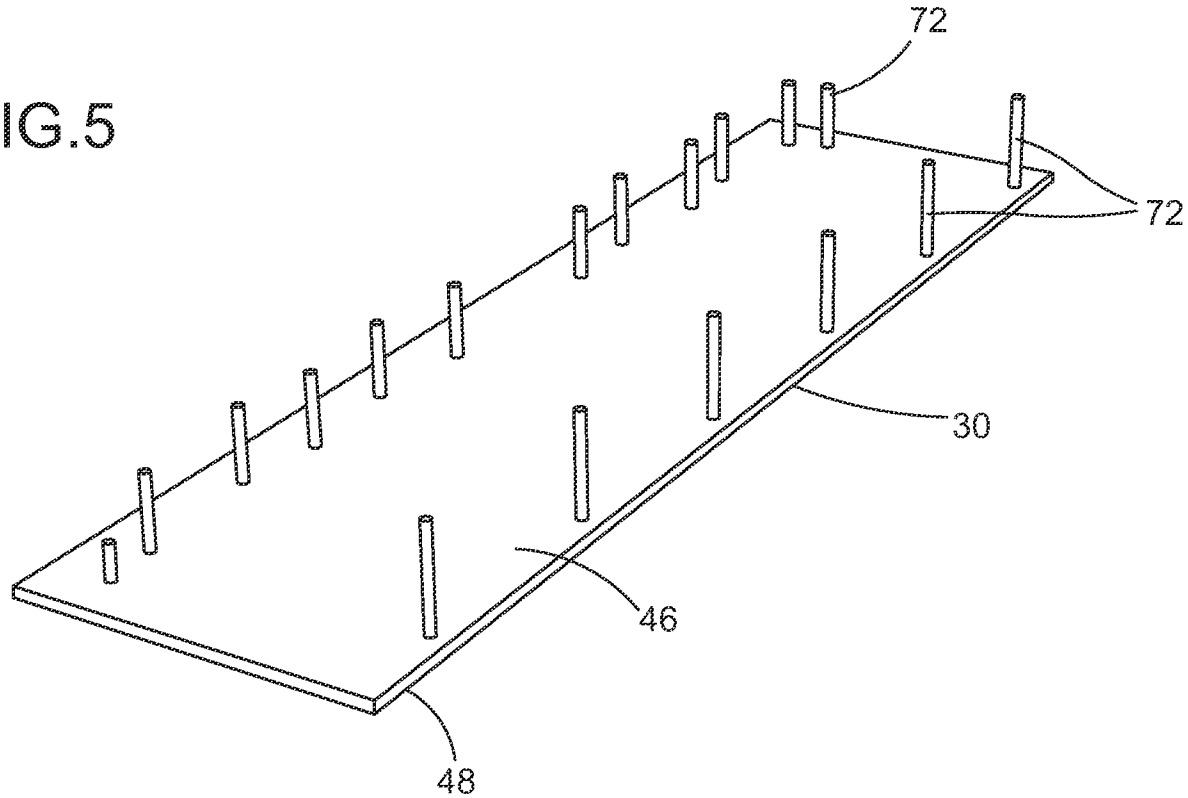
FIG. 5 is a perspective view of a screed plate, in accordance with aspects of the present disclosure.
Figure 6:
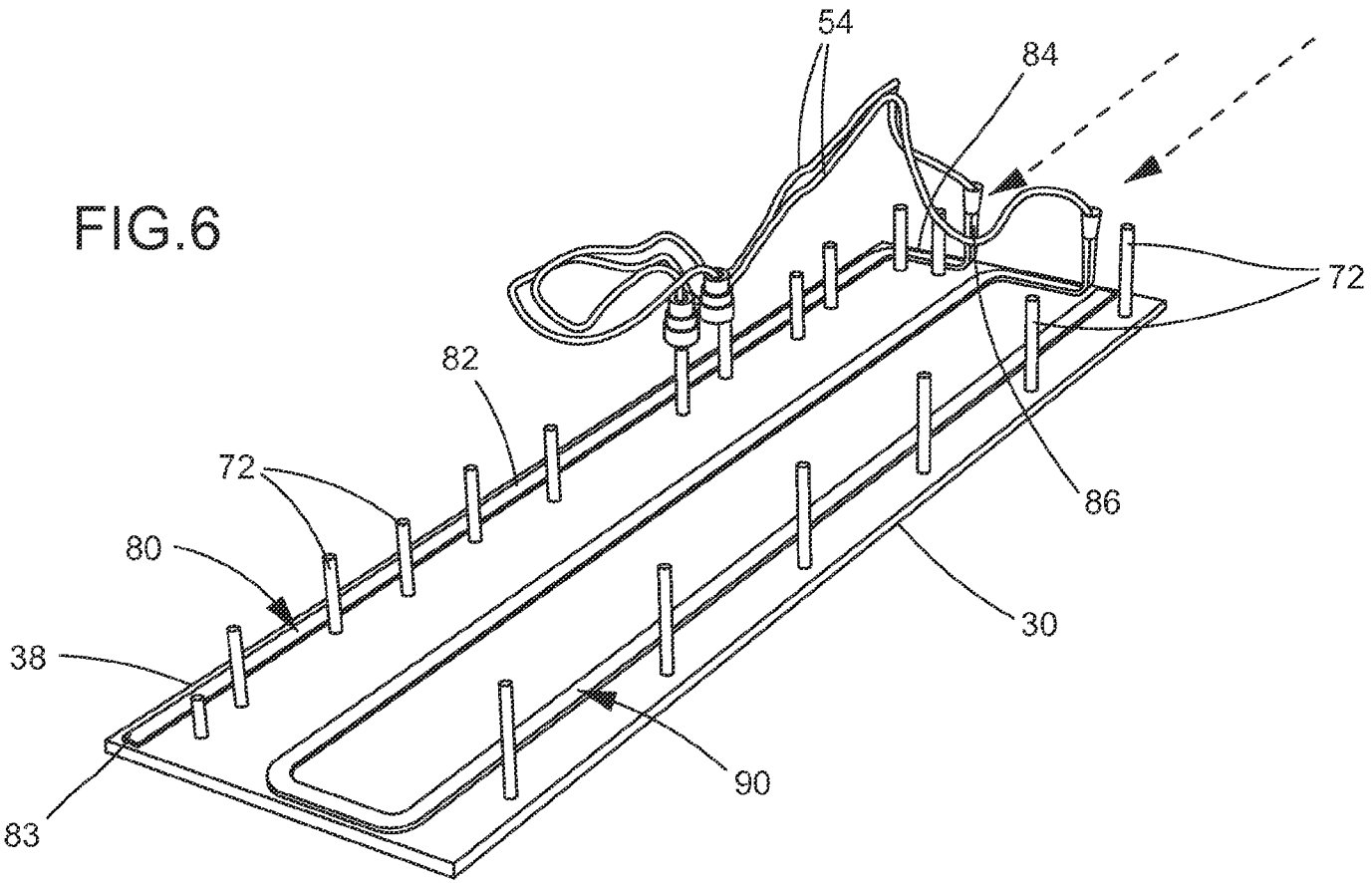
FIG. 6 is a perspective view of a screed plate with a plurality of heating elements, in accordance with aspects of the present disclosure.
Figure 7:
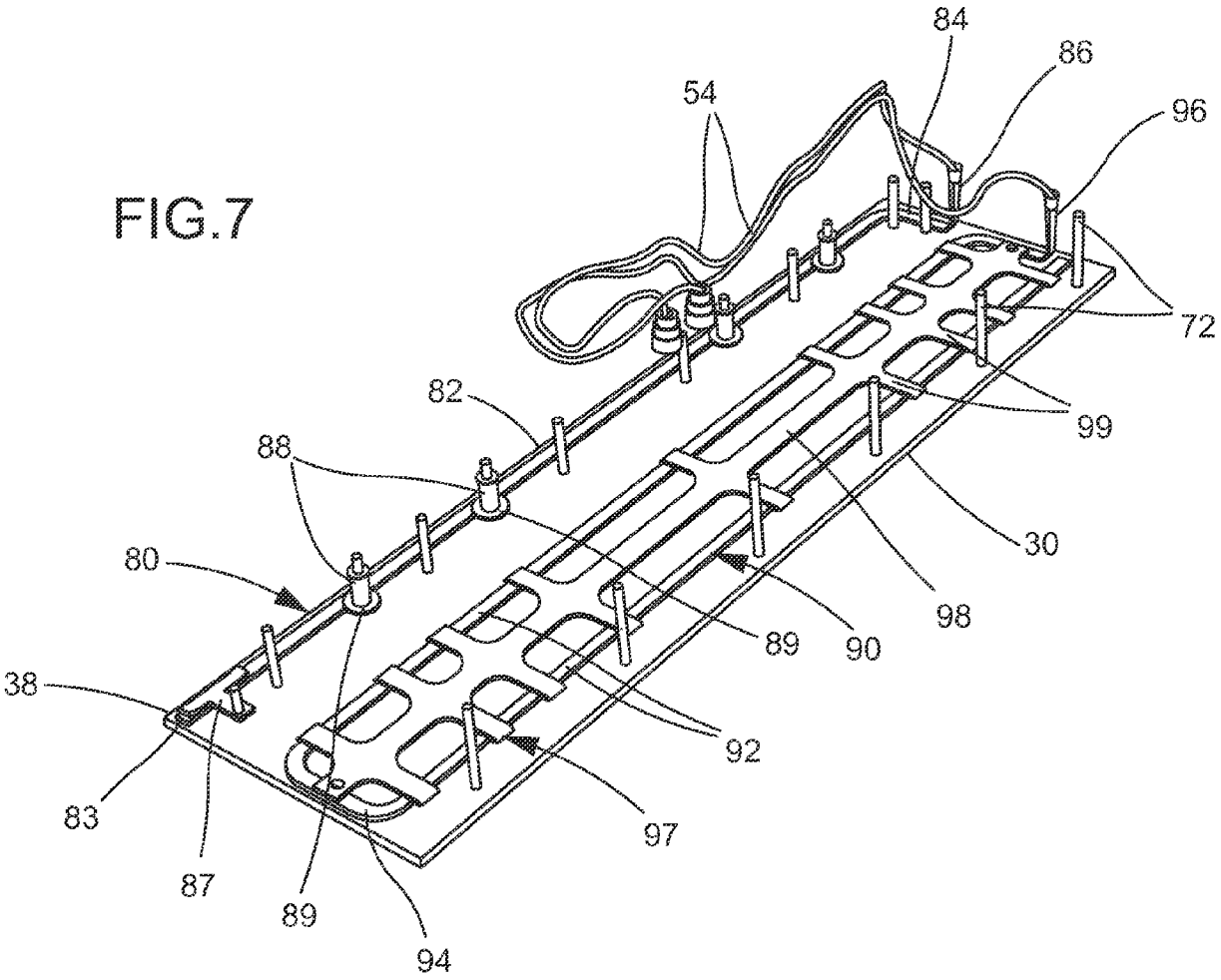
FIG. 7 is a perspective view of a screed plate with a plurality of heating elements and various hold down devices, in accordance with aspects of the present disclosure.

Accordingly, FIGS. 5-7 illustrate aspects of a heating assembly for use in heating the screed plate 30. As shown in FIG. 5, the screed plate 30, which may be a substantially flat metal plate, is configured with a network of frame posts 72. The frame posts 72 may be situated substantially toward peripheral portions of the screed plate 30, for example, and are of predetermined length to extend through corresponding openings 74 in the frame 32 (see FIG. 3). The frame posts 72 may be formed with external threading, for example, and fasteners, such as washers and nuts, may be used to secure the screed plate 30 to the frame 32 via the frame posts 72.

One or more heating elements may be configured for positioning on the upper surface 46 of the screed plate 30. In particular, as shown in FIG. 6, a first heating element 80 and a second heating element 90 (collectively heating elements 50 as described above) may be substantially flat elongated conducting elements formed to slide into the space 70 as illustrated FIGS. 3 and 4 (e.g., the direction indicated by the arrows in FIG. 6).

The first heating element 80 may be configured in an extended L shape, comprising a longitudinal run 82 and a shorter terminal run 84. The longitudinal run 82 may extend substantially an entire transverse dimension of the screed plate 30 from the shorter terminal run 84 of the heating element 80 to a distal end 83. The shorter terminal run 84 may be arranged to extend in a substantially planar manner perpendicularly from the longitudinal run 82. A positioning post 86 may be formed at an end of the terminal run 84 that rises substantially vertically and permits coupling to or extension of a lead 54. The configuration of the first heating element 80, in combination with the positioning of the frame posts 72, allows efficient placement and positioning of the heating element 80 into the screed assembly 12 without removal of the frame 32 even when it may be difficult to see into the space 70 into which the heating element 80 is being inserted.

The heating element 80 described above is configured to slide into the space 70 by insertion of the distal end 83 between the forward portion of the frame 32 and the frame posts 72. The longitudinal run 82 is positioned forward of the frame posts 72, parallel to and nearly abutting the forward leading edge 38 of the screed plate 30. Referring back to FIG. 3, the frame 32 may be provided with notches 33 corresponding to the positioning post 86, The notches 33 and positioning post 86 provide visual indications for efficient alignment and positioning of the heating element 80 during insertion.

To maximize heat transfer from the heating element 80 to the screed plate 30, a number of hold down devices may be provided to easily and efficiently secure the heating element 80 with maximum surface contact being maintained between the heating element 80 and the upper surface 46 of the screed plate 30. For example, as shown in FIG. 7, a hold down clamp 87 may be provided to secure the distal end 83 of the heating element 80. The hold down clamp 87 may be coupled to the screed plate by a suitable securing means, and comprise a metal T-plate having ramped arms for receiving the distal end 83 of the heating element 80. The ramped arms of the hold down clamp 87 allow the distal end 83 to be easily accepted when sliding into position while progressively applying increased downward pressure until the distal end 83 is in a final position and firmly secured by the full holding force of the hold down clamp 87.

Figure 8:
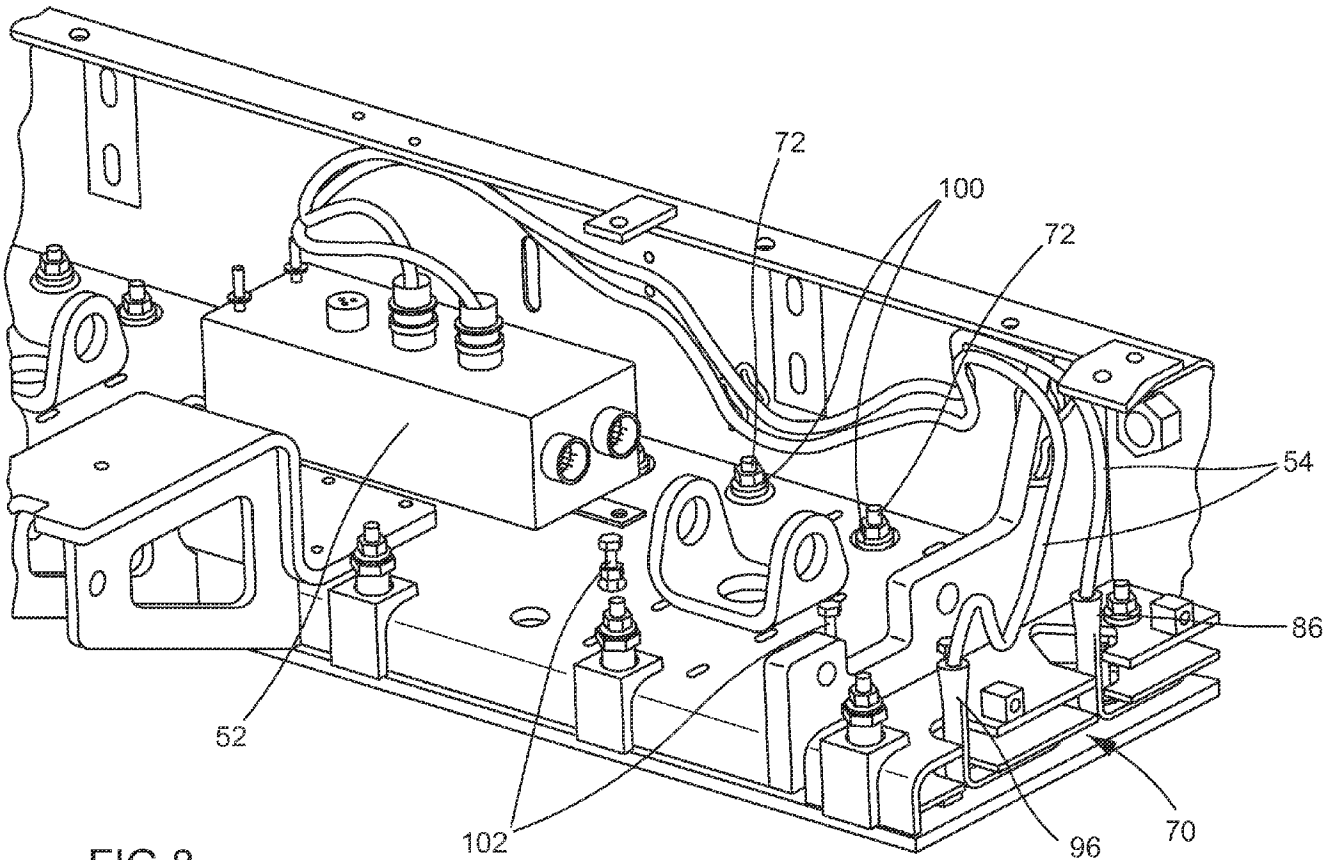
FIG. 8 is another close up perspective view of a screed assembly, in accordance with aspects of the present disclosure.

In accordance with yet other aspects of the present disclosure, bobbins 88 may be used to provide periodic holding forces along the longitudinal run 82 of the first heating element 80. Each bobbin 88 may be configured with a lower flanged portion 89 and be formed to slidably mount onto the frame posts 72. Referring back to HG. 3, the bobbins 88 may be configured to extend through the openings 74 (refer to FIG. 3) in the frame 32. Thus, when the frame 32 is secured to the screed plate 30 via a securing device 100, such as lock nut assembly or a washer and nut assembly, as shown in FIG. 8, the bobbins 88 may be forced downward. The lower flanged portions 89 of the bobbins 88 are pressed against the heating element 80 to secure the heating element 80 in position and in constant contact with the upper surface 46 of the screed plate 30.

To release the holding force, the pressure being exerted by each bobbin 88 may be released by loosening the securing devices 100. Thus the holding forces applied by the bobbins 88 may be quickly and easily released without having to completely remove the screed plate 30 from the frame 32. Rather, the securing devices 100 are simply loosened to allow the bobbins 88 to release enough holding force so that the first heating element 80 may slide out from the space 70. A new heating element 80 may then be inserted into the space 70 so that the longitudinal run 82 slides under the flanged portions 89 of the bobbins 88 until the distal end 83 of the new heating element is captured under the hold down clamp 87, for example. Tightening of the securing devices 100 on the frame posts 72 then provides the holding pressure against the bobbins 88 to securely hold the heating element 80 via the flanged portions 89.

With the skin temperature of the heating element 80 reaching 600°-700° F., maximum surface contact of the heating element 80 with the screed plate 30 near the leading edge 38 ensures that the leading edge 38 and forward surface areas of the lower surface 48 of the screed plate 30 are effectively heated. The asphalt paving material is prevented from cooling upon contact with the leading surfaces of the screed plate 30, preventing hardening and caking of the paving material on the screed plate 30 for maintaining a smooth paving surface as the screed plate 30 moves over the asphalt paving material.

Referring again to FIG. 6, the second heating element 90 may be inserted rearward of the first heating element 80 for heating the remainder of the screed plate 30. The second heating element 90 may be substantially rectangular in form with two parallel longitudinal runs 92 and two parallel transverse runs 94. A positioning post 96 may be formed at an end of one of the transverse runs 94, the positioning post 96 rising substantially vertically and permitting coupling of the second heating element to or extension of a lead 54. The configuration of the second heating element 90, in combination with the positioning of the frame posts 72, allows efficient placement and positioning of the heating element 90 into the screed assembly 12 without removal of the frame 32 even when it may be difficult to see into or access the space 70 into which the heating element 90 is being inserted. Referring back to FIG. 3, the frame 32 may be provided with notches 33 for positioning the positioning post 96.

For example, the heating element 90 described above is configured to slide into the space 70 so that one of the longitudinal runs 92 is situated toward the rearward arranged frame posts 72 and the other of the longitudinal runs 92 is situated toward the center of the screed plate 30. With the skin temperature of the heating element 90 reaching 600°-700° F., maximum surface contact of the heating element 90 is provided to effectively heat the remaining portions of the screed plate 30 not heated by the first heating element 80. The asphalt paving material is also prevented from cooling upon contact with the trailing surfaces of the screed plate 30, preventing adherence of the paving material on the screed plate 30 and allowing a smooth paving surface to be formed as the screed plate 30 moves over the asphalt paving material.

To maximize heat transfer from the heating element 90 to the screed plate 30, a number of hold down devices may be provided to easily and efficiently secure the heating element 90 with maximum surface contact being maintained between the heating element 90 and the screed plate 30. For example, as shown in FIG. 7, a hold down webbing 97 may be provided to secure the second heating element 90 in place. The hold down webbing 97 may be made from any suitable material, such as steel, aluminum, or a high-temperature carbon fiber composite, for example, and is configured to be lightweight and strong. The hold down webbing 97 may comprise a substantially longitudinal body 98 with extension arms 99 having slightly curved distal ends configured to straddle and hold the parallel longitudinal runs 92 at predetermined points. The hold down webbing 97 may be removable with the heating element 90 or may be configured to remain in the space 70 in the frame 32 during removal and/or insertion of the heating element 90. Securing devices, such as bolts and/or holding pockets built into the frame 32 may be used to hold the webbing 97 in the space 70.

The frame 32 may be configured so that hold down bolts 102, such as those shown in FIG. 8, may be used to apply downward pressure against the hold down webbing 97. The hold down bolts 102 may have distal ends, for example, designed to abut against the longitudinal body 98 of the webbing 97 in order to apply pressure against the webbing 97 when tightened. The pressure applied by tightening the hold down bolts 102 is distributed throughout the webbing 97 and, in particular the extension arms 99, to secure and hold the second heating element 90 in position with a maximum surface area of the heating element 90 pressed against the screed plate 30. In accordance with yet other aspects of the present disclosure, the hold down bolts 102 may be configured to be externally accessible for a technician working on the assembly. For example, the bolts may extend from the frame 32 in a manner that permits a technician to easily access the hold down bolts 102 without having to remove or move components, or without having to feel around in a blind cavity to locate and attempt to tighten or loosen the bolts.

As is described in more detail below with respect to yet another embodiment of the present disclosure, the webbing 97 may be configured with one or more slight longitudinal bends provided toward the middle of the longitudinal body 98. The bend(s) may form a 3-5° angle with a plane parallel to the screed plate 30, for example, to provide an increased lateral stiffness to the webbing 97 (see, e.g., FIG. 12). Accordingly, when the hold down bolts 102 are tightened to apply pressure against the longitudinal body 98, the webbing 97 distributes the force downward under the pressure to apply a holding force against the longitudinal runs 92. Although described above with a bend of 3-5°, any suitable bend from 1-15° may be used to provide increased lateral stiffness to the webbing 97. The external accessibility of the hold down bolts 102 may further enhance the ability of a technician to easily release and/or apply the downward pressure of the hold down bolts against the webbing 97. Exchange and/or maintenance of the heating elements in the field is thus greatly enhanced.

Figure 9:
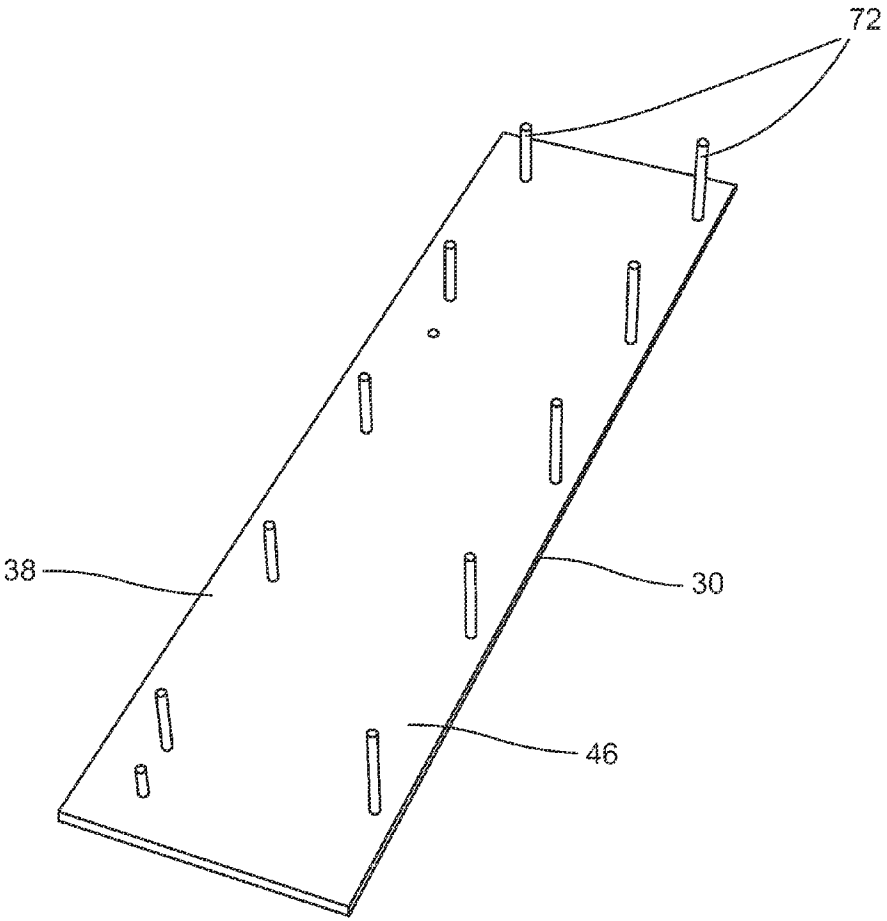
FIG. 9 is a perspective view of a screed plate configured for accommodating a single heating element, in accordance with aspects of the present disclosure.
Figure 10:
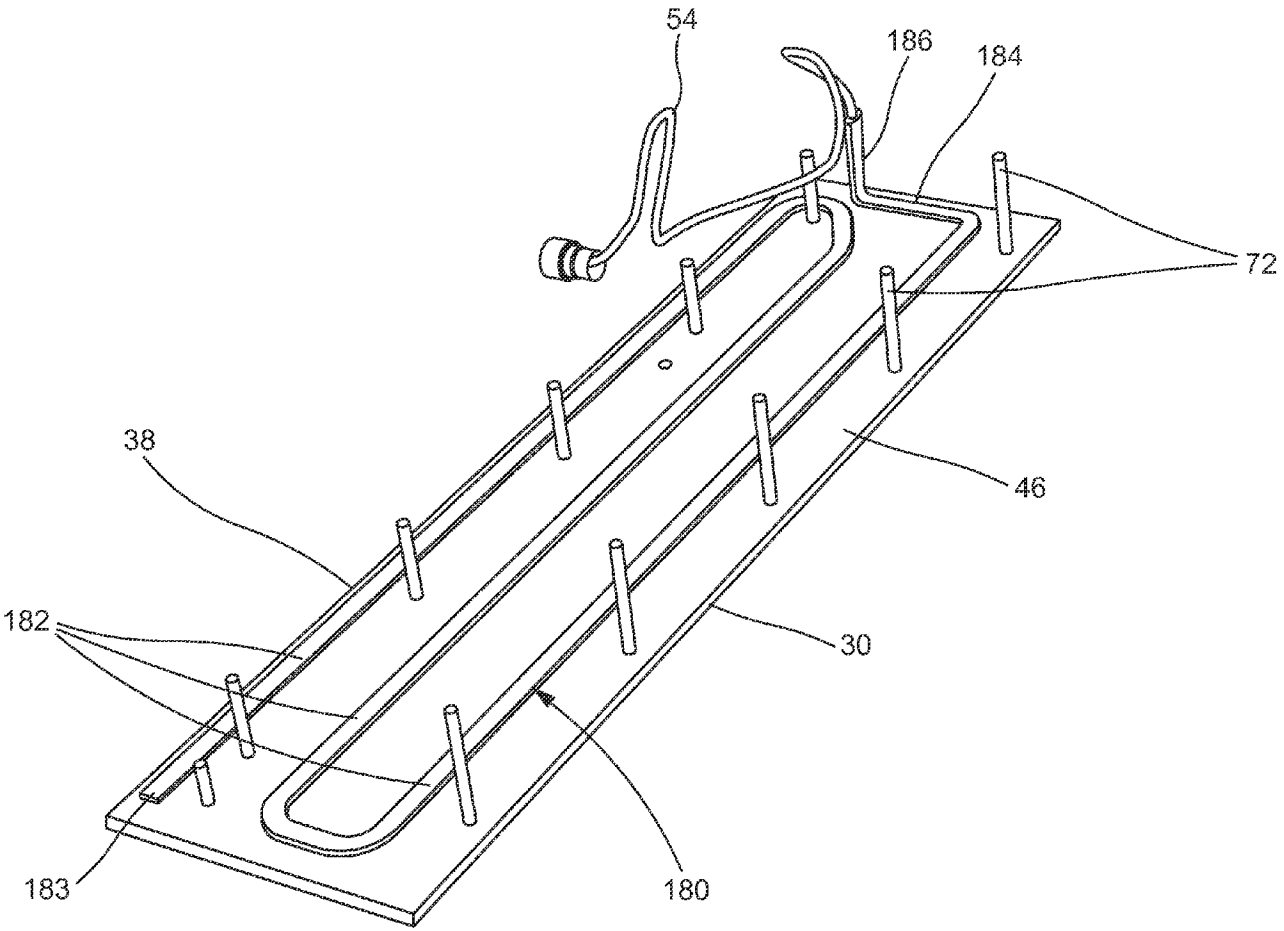
FIG. 10 is a perspective view of the screed plate of FIG. 9 with a heating element, in accordance with aspects of the present disclosure.

In accordance with yet other aspects of the present disclosure, FIGS. 9 and 10 illustrate a screed plate 30 in which the frame posts 72 may be arranged to accommodate insertion of a one-piece heating element 180, for example. The heating element 180 may be configured in a substantially planar S-shaped configuration defined by three parallel longitudinal runs 182 extending substantially the entire transverse dimension of the screed plate 30 and connected by U-shaped bends, a distal end 183, and a terminal end 184 that runs substantially perpendicular to the direction of the longitudinal runs 182. The terminal end 184 may be configured to have a positioning post 186 that rises substantially vertically and permits coupling to or extension of a lead 54.

The configuration of the one-piece heating element 180, in combination with the positioning of the frame posts 72, allows efficient placement and positioning of the heating element 180 into the screed assembly 12 without removal of the frame 32 even when it may be difficult to see into or access the space 70 into which the heating element 180 is being inserted.

The heating element 180 described above is configured to slide into the space 70 so that the distal end 183 slides between the frame posts 72 and the forward portion of the frame 32. The forward longitudinal run 182 with distal end 183 may thus be positioned forward of the frame posts 72, parallel to and nearly abutting the forward leading edge 38 of the screed plate 30. Referring back to FIG. 3, the frame 32 may be provided with notches 33 for positioning the positioning post 186. The notches 33 and positioning post 186 provide visual indications for efficient alignment and positioning of the heating element 180 during insertion.

Figure 11:
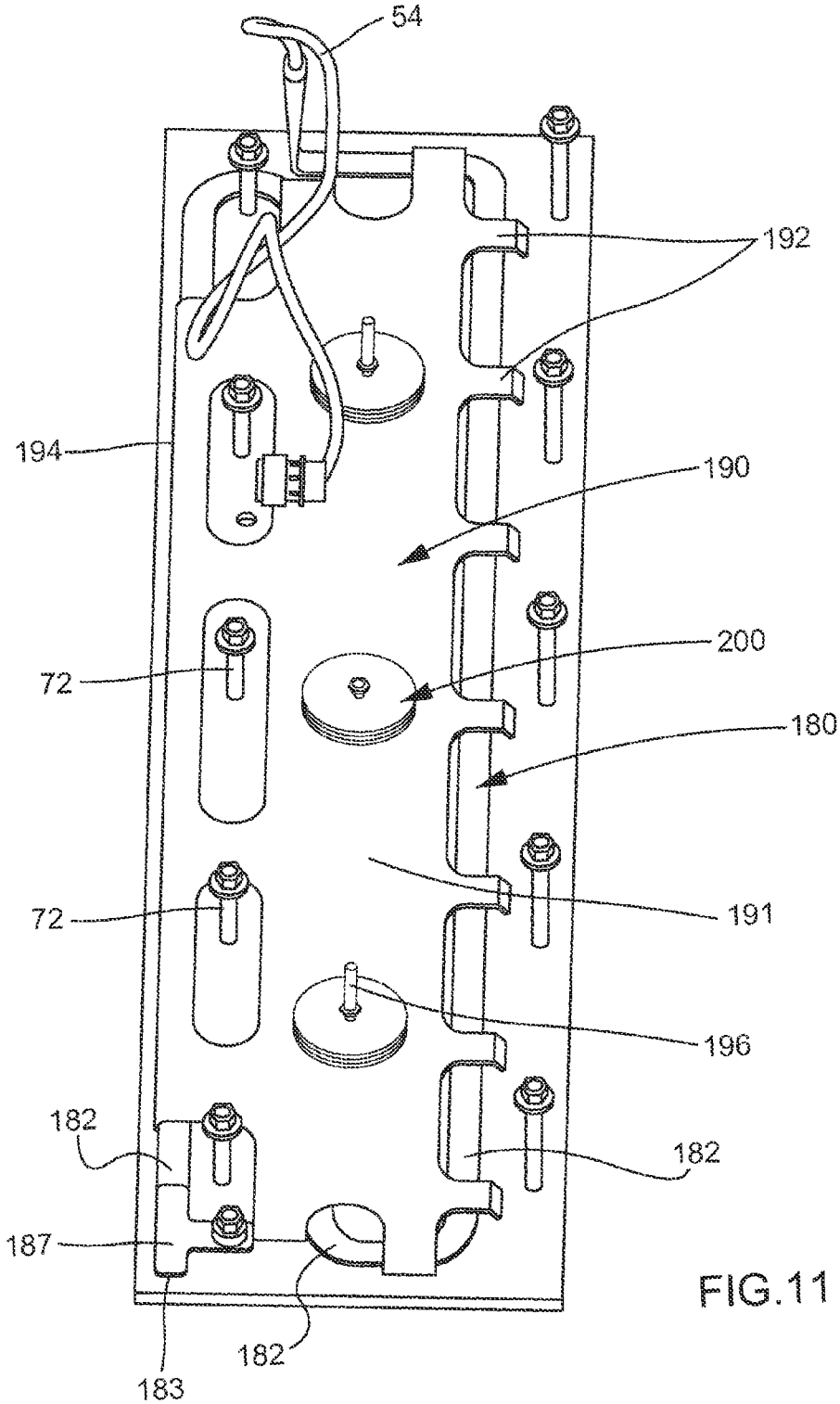
FIG. 11 is a perspective view of the screed plate of FIG. 9 with a heating element and various hold down devices, in accordance with aspects of the present disclosure.

To maximize heat transfer from the heating element 180 to the screed plate 30, a number of hold down devices may be provided to easily and efficiently secure the heating element 180 with maximum surface contact being maintained between the heating element 180 and a upper surface 46 of the screed plate 30. For example, as shown in FIG. 11, a hold down clamp 187 may be provided to secure the distal end 183 of the heating element 180. The hold down clamp 187 may be coupled to the screed plate 30 by a suitable securing means, and comprise a metal T-plate having ramped arms for receiving the distal end 183 of the heating element 180. The ramped arms of the hold down clamp 187 allow the distal end 183 to be easily accepted when sliding into position while progressively applying increased downward pressure until the distal end 183 is in a final position and firmly secured by the full holding force of the hold down clamp 187.

In accordance with yet other aspects of the present disclosure, a hold down webbing 190 may be provided to secure the one-piece heating element 180 in place. Although described herein with reference to a one-piece heating element 180, the webbing 190 may be used with a variety of other configurations of heating elements, including a plurality of heating elements. The hold down webbing 190 may be made from any suitable material, such as steel, aluminum, or a high-temperature carbon fiber composite, for example, and is configured to be lightweight and strong. The hold down webbing 190 may comprise a substantially longitudinal body 191 with extension arms 192 having slightly curved distal ends configured to straddle and hold the heating element 180. A holding rail 194 may be provided to further assist in positioning and holding down the forward longitudinal run 182 of heating element 180.

Figure 12:
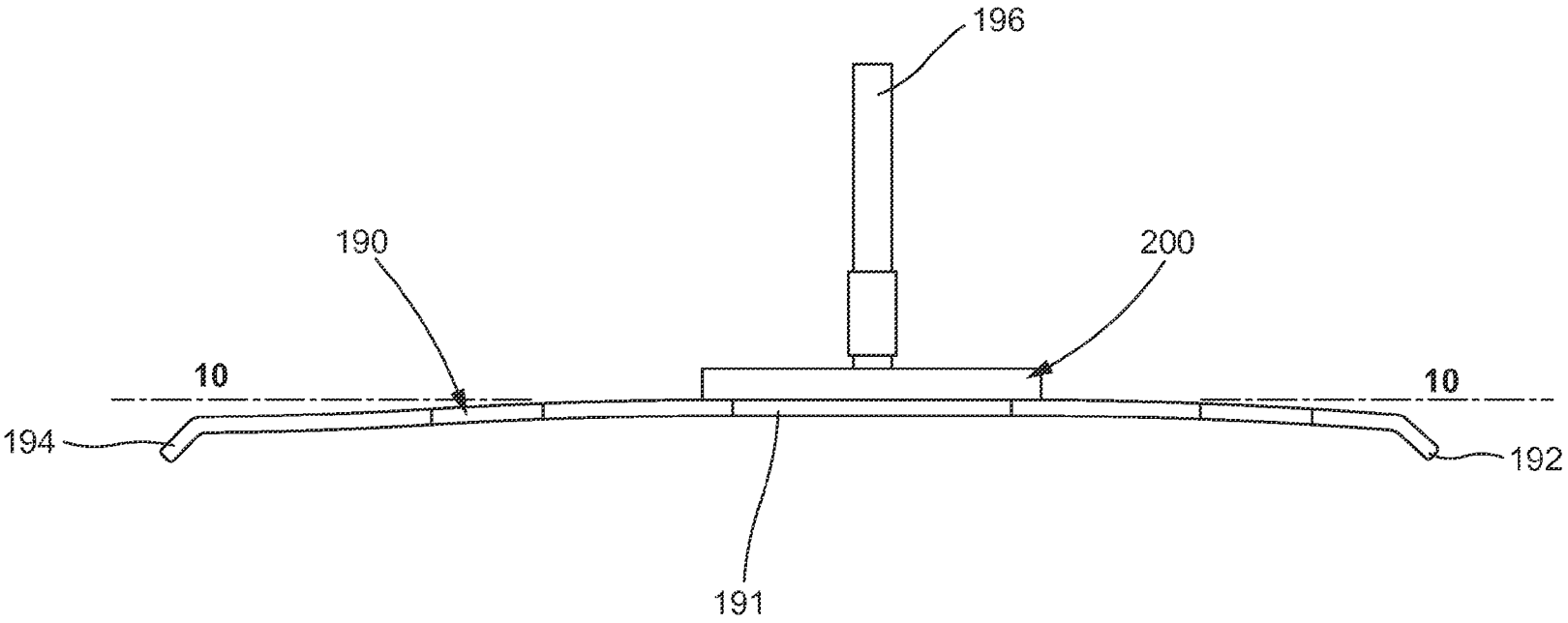
FIG. 12 is a side view of the screed plate of FIG. 9, in accordance with aspects of the present disclosure.

In accordance with yet other aspects of the present disclosure, as shown in FIGS. 11 and 12, the hold down webbing 190 may be configured with a plurality of studs 196 that extend from a central portion of the longitudinal body 191. At least some of the studs 196 extend through the frame 32, effectively positioning the hold down webbing 190 relative to the frame 32. Biasing devices 200, which may be wave springs sandwiched between two spring plates, for example, may be mounted on the studs 196 and used to apply variable downward pressure against the hold down webbing 190. The biasing devices 200 may be situated such that when the frame 32 is in place and secured, the biasing devices 200 are compressed between the frame 32 and the hold down webbing 190. The biasing devices 200 may thus exert a downward pressure against the hold down webbing 190 such that the heating element 180 is secured. The biasing devices 200 maintain a distributed pressure against the webbing 190 during use of the screed assembly yet provide enough flexibility for the easy removal and/or insertion of the heating element 180 secured underneath the webbing 190. As is illustrated inn FIG. 12, the webbing 190 may be configured with a slight bend θ (e.g., 3°-5°) from parallel with the screed plate 30 along one or more portions of the longitudinal body 191 when viewed from a side. The bends may provide a slight elevation to the body 191 and provide an increased lateral stiffness to the webbing 190 while ensuring an even lateral distribution of pressure, for example, to secure and maintain the position of the heating element 180 against the screed plate 30. Although described above with a bend of 3-5°, any suitable bend from 1-15° may be used to provide increased lateral stiffness to the webbing 97.

With the skin temperature of the heating element 180 reaching 600°-700° F., maximum surface contact of the heating element 180 with the upper surface 46 is provided near the leading edge 38 and generally along all portions of the screed plate 30. The asphalt paving material is thus effectively prevented from cooling upon contact with the leading surfaces of the screed plate 30, preventing hardening of the paving material on the screed plate 30 and allowing a smooth paving surface to be formed as the screed plate 30 moves over the asphalt paving material. In addition, direct heat transfer to the frame 32 may be reduced through the configuration described herein.

INDUSTRIAL APPLICABILITY

The disclosure includes a system and methods for effectively holding down heating elements during operational use of a heated screed plate assembly while providing an efficient configuration for easily removing and/or replacing the heating elements without having to disassemble the screed plate assembly. The lower screed interfaces disclosed are for use on an asphalt paving machine.

The many features and advantages of the disclosure are apparent from the detailed specification, and, thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

We claim:

1. A screed interface assembly comprising:
- a screed assembly frame having an end plate;
- a screed plate removably connected to the screed assembly frame along an edge of the end plate;
- a heating element, comprising:
  - a longitudinal run extending substantially across an entire transverse surface of the screed plate; and
  - a shorter run configured to extend perpendicularly from the transverse surface of the screed plate, the shorter run further configured to be heated;
- a hold down device for securing the heating element to the screed plate, the hold down device comprising a metal webbing having a longitudinal body portion and a plurality of extension arms configured to straddle and secure the heating element; and
- a heating element receiving region on the end plate configured to receive the heating element,
- wherein the heating element is configured to be removed from the screed plate by sliding the heating element through the heating element receiving region and disengaging the heating element from the hold down device without disengaging the screed plate from the screed assembly frame.

2. The assembly of claim 1, wherein the screed plate comprises a leading edge, a trailing edge, an upper surface extending between the leading edge and the trailing edge, and frame posts extending from the upper surface for mounting the screed plate to the screed assembly frame.

3. The assembly of claim 1, wherein the longitudinal run has a substantially planar S-shaped configuration defined by at least three parallel longitudinal regions.

4. The assembly of claim 1, wherein the screed assembly frame is configured with at least one notch and the positioning post aligns with the at least one notch when the heating element is positioned onto the screed plate.

5. The assembly of claim 1, further comprising a second hold down device, the second hold down device being a metal T-plate having ramped arms for receiving and securing the distal end of the longitudinal run.

6. The assembly of claim 5, further comprising hold down bolts, wherein the hold down bolts are mounted through the assembly frame and apply a distributed pressure against the heating element via the metal webbing.

7. The assembly of claim 1, further comprising a second hold down device, the second hold down device being a bobbin mounted on at least one framing post, the bobbin having a lower flange portion for securing the heating element at a select location along the longitudinal run.

8. The assembly of claim 1, wherein the metal webbing includes a stud that extends from the longitudinal body portion of the metal webbing and the screed frame assembly includes a hole for receiving the stud therethrough.

9. The assembly of claim 8, further comprising a biasing device mounted on the stud for biasing the metal webbing toward the screed plate when the screed plate is secured to the screed frame assembly.

10. The assembly of claim 9, wherein the biasing device is a wave spring sandwiched between two spring plates for providing a variable applied force against the metal webbing.

11. The assembly of claim 1, further comprising a junction box mounted to the screed frame assembly and electrically coupled to an electric power supply.

12. The assembly of claim 11, further comprising a lead extending from the heating element and a connection incorporated into the junction box for completing the electrical circuit between the lead and the electric power supply.

13. A paving system for laying an asphalt paving material, comprising:
- a paving machine having an engine and a propelling arrangement; and
- a screed assembly attached to the paving machine, the screed assembly including:
  - a screed assembly frame having an end plate;
  - a screed plate removably connected to the screed assembly frame along an edge of the end plate;
  - a heating element, comprising;
    - a longitudinal run extending substantially across an entire transverse surface of the screed plate; and
    - a shorter run configured to extend perpendicularly from the transverse surface of the screed plate, the shorter run further configured to be heated;
  - a hold down device for securing the heating element to the screed plate, the hold down device comprising a metal webbing having a longitudinal body portion and a plurality of extension arms configured to straddle and secure the heating element;
  - a heating element receiving region on the end plate configured to receive the heating element; and
  - a biasing device mounted onto the hold down device configured to bias the hold down device toward the screed plate when the screed plate is secured to the screed frame assembly,
- wherein the heating element is configured to be removed from the screed plate by sliding the heating element through the heating element receiving region and disengaging the heating element from the hold down device without disengaging the screed plate from the screed assembly frame.

14. The paving system of claim 13, wherein the biasing device is a wave spring sandwiched between two spring plates to provide a variable applied force against the hold down device.

15. The paving system of claim 13, wherein the longitudinal run has a substantially planar S-shaped configuration defined by at least three parallel longitudinal regions.

16. The assembly of claim 13, further comprising a second hold down device, the second hold down device being a metal T-plate having ramped arms for receiving and securing the distal end of the longitudinal run.

17. The assembly of claim 16, further comprising hold down bolts, wherein the hold down bolts are mounted through the assembly frame and apply a distributed pressure against the heating element via the metal webbing.

18. The assembly of claim 13, further comprising a second hold down device, the second hold down device being a bobbin mounted on at least one framing post, the bobbin having a lower flange portion for securing the heating element at a select location along the longitudinal run.

19. The assembly of claim 13, wherein the metal webbing includes a stud that extends from the longitudinal body portion of the metal webbing and the screed frame assembly includes a hole for receiving the stud therethrough.

20. The assembly of claim 19, wherein the biasing device is mounted on the stud for biasing the metal webbing toward the screed plate when the screed plate is secured to the screed frame assembly.

* * * * *